United States Patent [19]

Rohmann

[11] 4,220,319

[45] Sep. 2, 1980

[54] OVENS

[75] Inventor: Siegfried Rohmann, Wiesbaden, Fed. Rep. of Germany

[73] Assignee: Westofen GmbH, Wiesbaden, Fed. Rep. of Germany

[21] Appl. No.: 43,099

[22] Filed: May 29, 1979

[30] Foreign Application Priority Data

May 31, 1978 [GB] United Kingdom ..... 25984/78

[51] Int. Cl.[3] ..... C21D 11/00; C21C 5/42

[52] U.S. Cl. ..... 266/89; 266/94; 266/239

[58] Field of Search ..... 266/89, 92, 94, 195, 266/236, 239

[56] References Cited

U.S. PATENT DOCUMENTS

| | | | |
|---|---|---|---|
| 3,441,261 | 4/1969 | Sommer | 266/89 |
| 3,504,825 | 4/1970 | Diamond | 266/239 |
| 3,504,899 | 4/1970 | Breuer | 266/89 |
| 3,675,911 | 7/1972 | Kapun | 266/94 |

OTHER PUBLICATIONS

German Printed Application 1,558,279, Nov. 20, 1969.

*Primary Examiner*—T. Tufariello

*Attorney, Agent, or Firm*—Wenderoth, Lind & Ponack

[57] ABSTRACT

There is disclosed a device for delivering predetermined metered quantities of molten metal having a holding vessel and pressure means for forcing molten metal out of the vessel through an outlet pipe, means for controlling the pressure means and sensing means for sensing when the molten metal has reached a discharge location in the outlet pipe from which it can be discharged, the sensing means being movably mounted above the discharge location.

The sensing means are preferably mounted on a motorized carrier so as to be capable of and are advanced towards the discharge location and withdrawn therefrom being guided so as to be in contact with the metal surface but not dipping into it.

4 Claims, 2 Drawing Figures

OVENS

BACKGROUND OF THE INVENTION

1. Field of the Invention

The invention relates to a device for supplying predetermined metered quantities of molten metal, so called "dosing", which has a hermetically sealed vessel with a metal outlet pipe within which is arranged a sensor which signals the metal level, which sensor is coupled with a valve in a pressurized gas supply which is used to drive the molten metal out of the vessel, and by means of a time-switch is also coupled with a valve in a gas exhaust from the vessel and which is preferably provided with a feed device for pressurized transfer gas for delivering a predetermined amount of molten metal and an automatic pressurized gas regulation for balancing the pressure in the vessel when the vessel is being emptied, so that the same amount of metal is still delivered in each delivery cycle whether the vessel is nearly full or is nearly empty.

2. The State of the Prior Art

When pushing precisely defined amounts of molten metal by means of pressurized air out of the vessel of a dosing device, as shown in German AUS No. 2022989, which is often also called a melting oven or a heat holding oven, it is known that particular problems are liable to occur. Thus when one applies the same dosing pressure for the same time interval, ever smaller amounts of metal are delivered out of the outlet tube due to the gradual sinking of the molten metal level in the vessel. This can be explained by the fact that the pressure P is made up of two components P1 and P2. P1 is the pressure which is necessary in order to push the molten metal out of the oven to the outlet opening of the outlet tube, whilst P2 is the pure transfer pressure which is maintained for a predetermined time interval, and which results in the required amount of metal being pushed out of the outlet tube into the receiving receptacle or location, e.g. a mould.

It is obvious that the partial pressure P2 is constant, whilst the partial pressure P1 is variable in that when the molten metal level is falling, a higher partial pressure P1 must be used in order to fill the even greater space in the vessel by means of a rise in pressure due to the sinking level of the molten metal.

Various different ways have been suggested to achieve the necessary increase in P1 during the emptying of the vessel by repeated delivery of metered quantities of metal. Thus, it has been suggested that the molten metal be delivered by means of a dosing device which is combined with a special pouring chamber to which molten metal is transferred from the melting vessel and in which pouring chamber the level of the molten metal is always held at a constant level. Apart from the fact that the method of construction of such a device produces special problems due to the special pouring chamber, no great precision can be expected from this method because particularly in the course of time, changes and deposits occur on the walls of the pouring chamber which alter its volume.

BRIEF STATEMENT OF THE INVENTION

According to the present invention, a device for delivering predetermined metered quantities of molten metal has a holding vessel and pressure means for forcing molten metal out of the vessel through an outlet pipe, means for controlling the pressure means and sensing means for sensing when the molten metal has reached a discharge location in the outlet pipe from which it can be discharged, the sensing means being movably mounted above the discharge location.

The sensing means may be mounted on a motorized carrier so as to be capable of being advanced towards the discharge location and withdrawn therefrom. Such movement of the sensing means is preferably arranged to be under the control of the control means, which are arranged to guide the sensing means into contact with the metal surface, but to prevent them dipping into the molten metal.

The outlet pipe preferably comprises a vertical riser having an open top with an outlet opening at one side communicating with a downwardly inclined discharge pipe or spout, the discharge location being the level at which the riser and the discharge pipe communicate.

In a preferred form of the invention, the device comprises a hermetically sealed vessel, gas supply means to the interior of the vessel, and control and venting means for the gas supply, the sensing means being coupled to a valve in the gas supply and by means of a time switch also coupled to a valve in the gas venting means, the sensing means also being provided with an electronically controlled feeding device for pressurized gas transfer for delivering predetermined amounts of molten metal from the vessel and an automatic pressurized gas regulator for adjusting the vessel pressure whilst the vessel is being emptied. The interior of the vessel is preferably pneumatically connected to a differential pressure measurer which registers the predetermined transfer pressure independently of the level of metal in the vessel and to a transmitter which measures the pressure in the vessel, the two being electrically coupled to a comparator which in turn is electrically connected to a threshold value switch which controls the pressurized gas supply valve.

BRIEF DESCRIPTION OF THE DRAWINGS

The invention may be put into practice in various ways and one specific embodiment will be described by way of example to illustrate the invention with reference to the accompanying drawings in which.

DETAILED DESCRIPTION OF THE INVENTION

Figure 1:
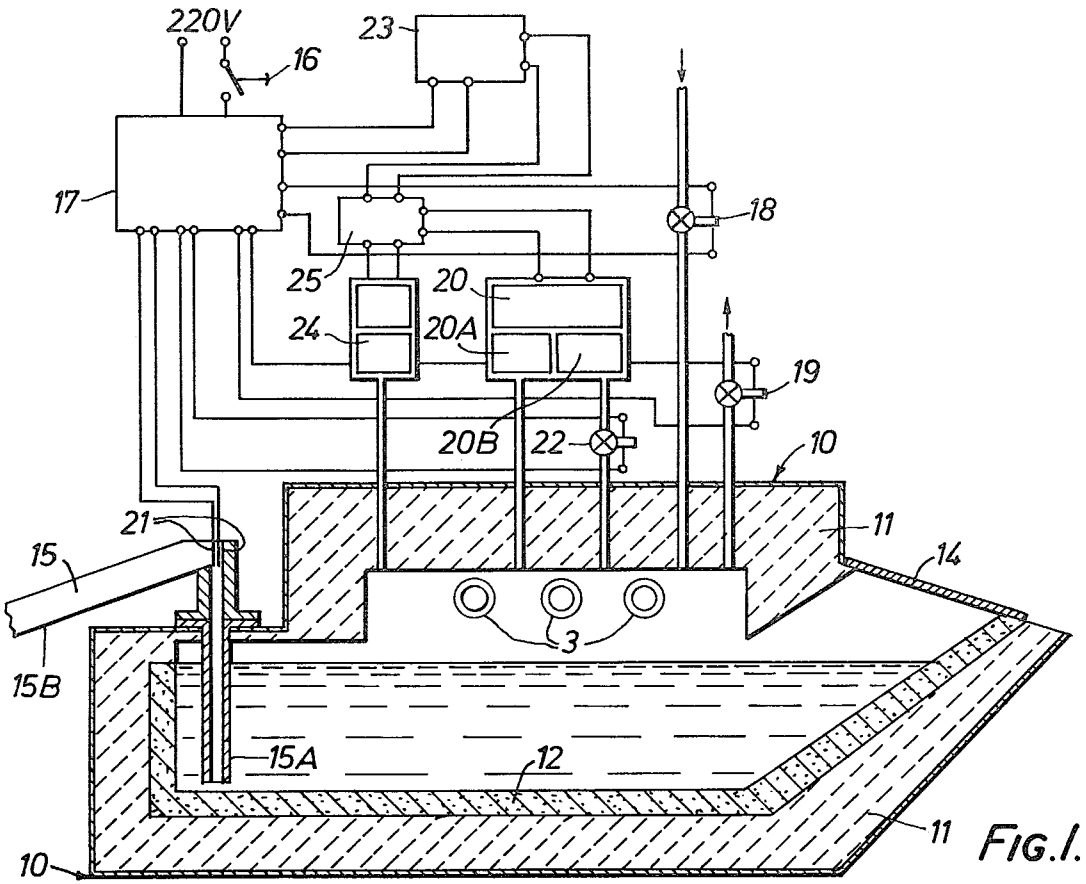
FIG. 1 is a diagrammatic cross sectional view of a dosing oven in accordance with the invention showing the control circuitry.

The dosing device has a vessel adapted to contain molten metal and formed from a pressure tight steel sheet housing 10 with efficient insulation 11 arranged on all sides. The refractory lining 12 is resistant to molten metals and to corrosive refining agents. The heating is achieved by resistive heating using steel tubes 13. The vessel is filled with metal through a filling and cleaning flap 14. Molten metal is delivered from the vessel to the place of use through a delivery tube 15 whose part 15A is of cast iron and whose part 15B is of steel plate with a refractory lining.

Operation of the device is initiated by pressing a pressure button 16. This activates a protective control circuit 17 which opens a pressurized air inlet valve 18 from a supply of air under pressure and which simultaneously closes an exhaust valve 19 connected to the interior of the vessel. The pressure in the vessel now rises. A differential pressure transmitter (transducer) 20 is connected to the interior of the vessel, one measuring chamber 20A being directly connected, and the other 20B being connected via a valve 22 which is under the control of the circuit 17. A pressure transmitter (transducer 24 is also directly connected to the interior of the vessel. The pressure thus rises in both measuring chambers 20A and 20B of the differential pressure transmitter 20, which may also be called the output electronics, and the pressure also rises in the transmitter 24.

Figure 2:
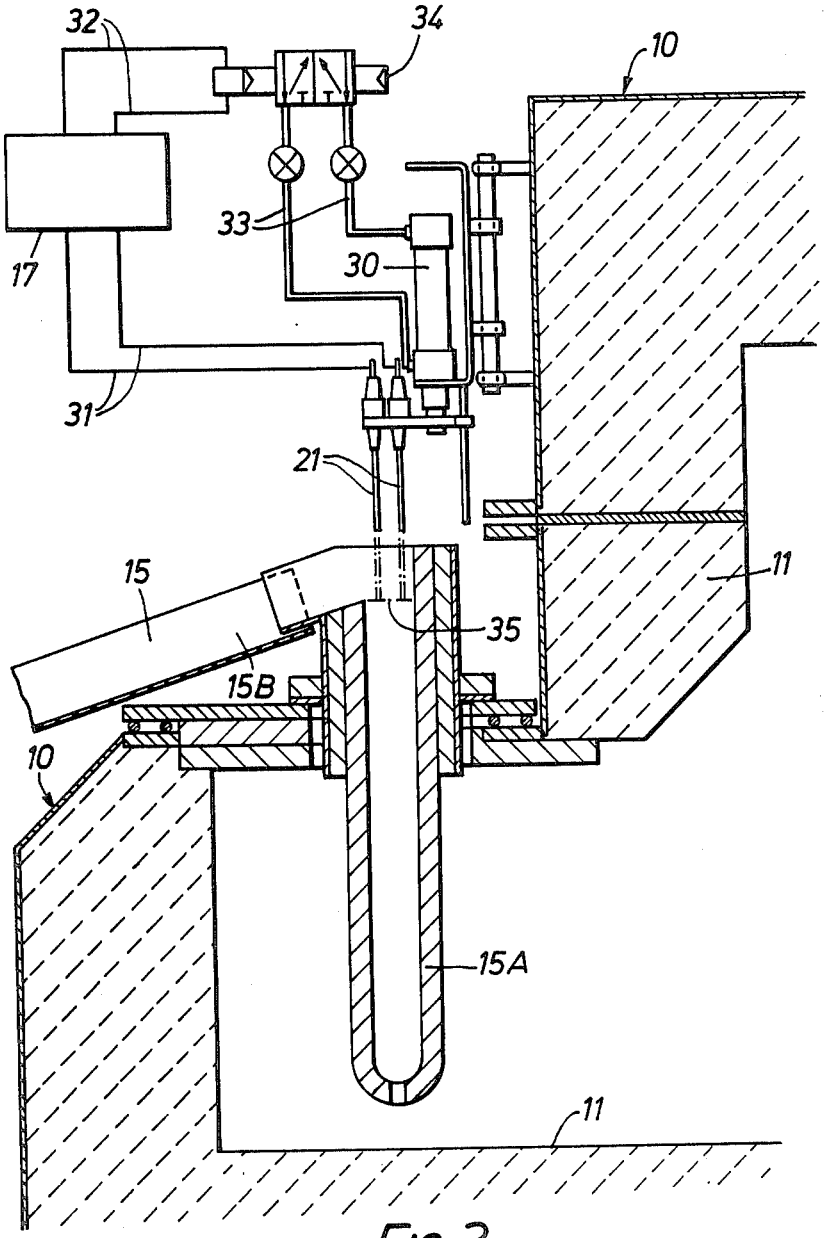
FIG. 2 is a detailed cross section of part of the oven shown in FIG. 1 showing the mechanical arrangement of the metal sensing electrodes.

Molten metal thus rises out of the vessel under the influence of the pressurized air up the delivery tube 15A until it reaches electrodes 21. The electrodes are movably mounted above the top end of the tube 15A. The mechanical and electrical arrangement of the electrodes is shown in FIG. 2 and will be described in more detail below. This is the moment at which the pressure P1 present in the vessel which is dependent on the starting level of the molten metal in the vessel is reached and a short-circuit signal is given to the protective control 17. The circuit 17 then closes the valve 22 between the vessel and the measuring chamber 20B of the differential pressure transmitter 20. The pressure P1 in the measuring chamber 20B is now sealed into it and this gives a reference value. The pressurized air inlet valve 18 remains open so that the pressure P equal to P1 and P2 can form in the vessel and in the measuring chamber 20A of the differential pressure transmitter 20 and in the transmitter 24. A time relay is connected to the electrodes 21 and thus an exactly dosed amount of the molten metal now flows out of the delivery tube 15. The chosen pressure P2 is set on a threshold value switch 23. As soon as the pressure P2 is reached, this fact is signalled by means of a current pulse by a comparator 25, which is also termed a mixer, to the threshold value switch 23 and the pressure inlet valve 18 is then closed. After the pouring time which is set by the time relay has elapsed, the inlet valve 18 is closed and the exhaust valve 19 and the valve 22 are opened and the pressure in the vessel immediately drops to atmospheric. In this manner, the delivery of molten metal from the opening in the delivery tube 15 instantaneously ceases, the metal in the delivery tube 15A falls back to the level of the metal in the vessel and the pouring process ceases.

The operation of the comparator 25 which mixes the current pulses from the differential pressure transmitter 20 and from the transmitter 24 is particularly important. When the pressure P1 is achieved, the valve 22 is closed and pressure P1 is sealed within the measuring chamber 20B. When, in the course of the pressure rise in the vessel and in the measuring chamber 20A, a pressure P equal to P1 and P2 has formed, the differential pressure transmitter 20 indicates the pressure P1 and P2−P1 equals P2 to the comparator 25. The pressure P equal P1 and P2 is simultaneously present in the transmitter 24. Since P1, as explained above, varies with the level of molten metal (that is to say when the level is sinking, a higher pressure P1 is necessary in order to transfer the molten metal from the height of the level of the metal in the vessel to the top of the delivery tube 15A) the current impulse from the transmitter 24 has a corrective effect on the current impulse from the differential pressure transmitter 20 in the comparator 25. Thus, in accordance with the invention, the impulse from the transmitter 24 can be fed into the comparator 25 either at its full value or at a percentage of its full value calibrated in accordance with the construction of the vessel and the type of molten metal being handled.

The current impulse from the transmitter 24 which is dependent upon the variable partial pressure P1, is subtracted in the comparator 25 from the current impulse which is equivalent to the partial pressure P2 coming from the differential pressure transmitter 20 so that the comparator 25 signals to the threshold value switch 23, a pressure which is reduced by a correction factor. The pressure P2 for the dosing has been set in the threshold value switch 23, in relation to the time relay. Thus threshold value switch 23 switches later when that higher pressure is present in the vessel which corresponds to the corrected partial pressure P1 which grows greater in the course of time due to the sinking of the level of the molten metal.

The following example illustrates the method numerically. Let the vessel be so dimensioned that it can be assumed that when completely filled, the partial pressure P1 will need to have a value of 500 mm head of water and when the vessel is almost completely emptied, the partial pressure P1 will need to have a value of 1000 mm head of water. Further, one may assume that when choosing the dosing, the transfer or partial pressure P2 will need to have a value of 200 mm head of water. The differential pressure transmitter 20 will aways send out a current impulse corresponding to 200 mm of water to the comparator 25 regardless of whether the vessel is full or almost empty, on the otherhand, the current impulse of the transmitter 24 varies according to the value of partial pressure P1 which can assume a value of between 500 and 1000 mm of water. When the vessel is completely full the transmitter 24 registers a pressure P equals P1+P2 equals 500 mm of water+200 mm of water equals 700 mm of water, however, when the vessel is almost completely empty, the pressure P equals P1+P2 equals 1000 mm of water+200 mm of water equals 1200 mm of water. Thus, the differential pressure transmitter should so work that 0 to 200 mm of water corresponds to an impulse current of 0 to 20 milliamps and thus, 10 mm of water is equal to 1 milliamp. The transmitter 24 on the other-hand is so chosen that 0 to 2000 mm of water corresponds to a current pulse of 0 to 200 milliamps so that 100 mm of water equal 1 milliamp.

As already stated, one undertakes a percentage adjustment of the impulse signal leaving the transmitter 24, which signal may be chosen to be between 0 and 100% of its full value corresponding to the dimensions of the vessel and the type of molten metal being handled. Thus during a first pouring run, one tests empirically which adjustments result in the optimal delivery or dosing. To continue with the example, it will be assumed that a value for this adjustment of 10% has shown itself to be suitable.

Thus for P2 equals 200 mm of water, a current impulse of 20 milliamps is sent from the differential pressure transmitter 20 to the comparator 25, whilst when the vessel is full, the transmitter 24 gives to the comparator 25 a current of 0.7 milliamps corresponding to 700 mm of water and when the oven is nearly empty, a current of 1.2 milliamps corresponding to 1200 mm of water. In the comparator 25, a subtraction now takes place; 20 milliamps from the differential pressure transmitter 20 minus 0.7 milliamps from the transmitter 24 equals 19.3 milliamps. This is the result when the vessel is full. When the vessel is nearly empty; 20 milliamps from differential pressure transmitter 20 minus 1.2 milliamps from the transmitter 24 equals 18.8 milliamps.

Since for the chosen time period, the value 20 milliamps (corresponding to 200 mm of water for P2) is predetermined and set into the threshold value switch 23, the threshold value switch 23 is only actuated when the correction factor is taken into account, that is to say, the pressure P2 has climbed so far above 200 mm of water that the extra pressure required due to the drop in the level of the metal in the vessel has been compensated for.

It can be appreciated from this example that the dosing device operates precisely and without sluggishness.

Turning now to FIG. 2 the electrodes 21 are arranged above the vertical portion 15A of the outlet tube 15 on a lifting cylinder 30, which guides the electrodes 21 on the metal surface 35 and does not allow them to dip into the molten metal. Thereby wetting of the electrodes with metal is substantially prevented so that the analysis and measurement process, which is very important for the control of the dosing oven, is substantially improved. The measurements become more exact which also has the result of making the dosing of the metal to be poured in, more precise. Furthermore, the operational safety of the dosing oven, is increased.

The electrodes 21 are arranged on the piston of a lifting cylinder 30 secured to the dosing oven and are shown in the raised position of rest. In the operational position (shown in chain dotted lines), the electrodes 21 reach into the part 15A of the outlet tube 15 and contact the surface of the metal 35. As soon as contact occurs between the electrodes 21 and the oxidized skin of the metal surface 35, an impulse current flows through the connections 31 of the protective control 17, which also controls the switching, measurement and control devices of the dosing oven as described above. The protective control 17 is also connected via lines 32 whereby it controls magnetic valves 34 which by means of air lines 33, control the supply and exhaust of air to the pneumatic lifting cylinder 30 in such a manner that, through the movements of the cylinder piston, the electrodes are guided onto the metal surface but are prevented from dipping into the molten metal, whereby the oxidized skin of the metal surface prevents wetting of the electrodes.

What is claimed is:

1. An apparatus for delivering predetermined metered quantities of molten metal, said apparatus comprising:

a vessel for holding molten metal, said vessel having an outlet pipe for the discharge therethrough of molten metal;

pressure means, connected to said vessel, for forcing said molten metal within said vessel to move through said outlet pipe to a discharge location therein from which said molten metal will begin to discharge;

sensing means, positioned above said discharge location, for sensing when said molten metal being moved through said outlet pipe reaches said discharge location, said sensing means comprising at least one electrode;

motorized carrier means, supporting and mounting said sensing means, for moving said sensing means to said discharge location to sense the arrival thereat of said molten metal, and for then withdrawing said sensing means away from said discharge location to prevent said sensing means from being wetted by or immersed within said molten metal; and control means operatively connected to said pressure means, said sensing means and said motorized carrier means for controlling the operation thereof.

2. An apparatus as claimed in claim 1, wherein said outlet pipe comprises a vertical riser having an open top with an outlet opening at one side communicating with a downwardly inclined discharge pipe, said discharging location being the level at which said riser and said discharge pipe communicate.

3. An apparatus as claimed in claim 1, wherein said vessel comprises a hermetically sealed vessel, said pressure means comprises gas supply means connected to the interior of the said vessel, and control and venting means for said gas supply means, said sensing means is coupled to a valve in said gas supply means and by means of a time switch coupled to a valve in said gas venting means, and said control means includes an electronically controlled feeding device for pressurized gas transfer to delivering predetermined amounts of molten metal from said vessel and an automatic pressurized gas regulator for adjusting the pressure in the said vessel while said vessel is being emptied.

4. An apparatus as claimed in claim 3, wherein the interior of said vessel is pneumatically connected to a differential pressure measurer which registers a predetermined transfer pressure independently of the level of metal in said vessel and to a transmitter which measures the pressure in said vessel, said differential pressure measurer and said transmitter being electrically coupled to a comparator which in turn is electrically connected to a threshold value switch which controls said valve in said gas supply means.

* * * * *